US005664633A

United States Patent [19]

Theurer et al.

[11] Patent Number: 5,664,633

[45] Date of Patent: *Sep. 9, 1997

[54] MACHINE FOR TREATING A BALLAST BED

[75] Inventors: Josef Theurer, Vienna; Herbert Wörgötter, Gallneukirchen, both of Austria

[73] Assignee: Franz Plasser Bahnbaumaschinen-Industriegesellschaft m.b.H., Vienna, Austria

[ * ] Notice: The term of this patent shall not extend beyond the expiration date of Pat. No. 5,611,403.

[21] Appl. No.: 683,909

[22] Filed: Jul. 19, 1996

[30] Foreign Application Priority Data

Sep. 4, 1995 [AT] Austria ..... 1470/95

[51] Int. Cl.[6] ..... F01B 27/10

[52] U.S. Cl. ..... 171/16; 104/12; 37/104; 37/107

[58] Field of Search ..... 37/104, 107; 104/2, 104/12, 307, 5, 6; 180/9.44; 171/16

[56] References Cited

U.S. PATENT DOCUMENTS

| | | | |
|---|---|---|---|
| 3,789,942 | 2/1974 | Kowalik | 180/9.44 |
| 3,981,247 | 9/1976 | Theurer | 104/12 |
| 4,450,771 | 5/1984 | Theurer et al. | 104/1 R |
| 4,921,732 | 5/1990 | Bounds | 427/325 |
| 5,456,180 | 10/1995 | Theurer et al. | 104/2 |
| 5,456,181 | 10/1995 | Theurer et al. | 104/2 |
| 5,553,674 | 9/1996 | Theurer et al. | 171/16 |

FOREIGN PATENT DOCUMENTS 4101432 7/1992 Germany .

*Primary Examiner*—Terry Lee Melius
*Assistant Examiner*—Robert Pezzuto
*Attorney, Agent, or Firm*—Collard & Roe, P.C.

[57] ABSTRACT

A machine for treating a ballast bed underneath a track comprises a machine frame extending in a longitudinal direction and supported on the track by undercarriages for movement in an operating direction, a suction unit mounted on the machine frame, the suction unit comprising a vertically and laterally adjustable suction pipe having a suction opening for aspirating ballast from the ballast bed, a conveyor band arranged on the machine frame to convey the aspirated ballast away from the suction unit, and a ballast discharge device mounted on the machine frame rearwardly of the suction pipe in the operating direction, the ballast discharge device comprising a hopper. A conveyor arrangement extends in the longitudinal direction on the machine frame and has an input end arranged to receive the aspirated ballast from the conveyor band and an output end arranged to discharge the aspirated ballast into the hopper. A track lifting unit is mounted on the machine frame between the suction opening and the ballast discharge device.

7 Claims, 1 Drawing Sheet

MACHINE FOR TREATING A BALLAST BED

BACKGROUND OF THE INVENTION

1. Field of the Invention

The present invention relates to a machine for treating a ballast bed underneath a track, comprising a machine frame extending in a longitudinal direction and supported on the track by undercarriages for movement in an operating direction, a suction unit mounted on the machine frame, the suction unit comprising a vertically and laterally adjustable suction pipe having a suction opening for aspirating ballast from the ballast bed, a conveyor band means arranged on the machine frame to convey the aspirated ballast away from the suction unit, a ballast discharge device mounted on the machine frame rearwardly of the suction pipe in the operating direction, the ballast discharge device comprising a hopper, and a track lifting unit mounted on the machine frame.

2. Description of the Prior Art

A machine of this type has been disclosed in copending U.S. patent application Ser. No. 08/313,211, filed Oct. 20, 1994, assigned to the same assignee as the present application. The machine may be used for aspirating and replacing an entire ballast bed underneath a track. With the aid of clearing means, the ballast underneath the track is removed by a suction pipe to a ballast storage container mounted on the machine frame, and the ballast storage container has a discharge opening to discharge the removed ballast onto a conveyor band arrangement. This conveyor arrangement conveys the ballast forwardly over a front end of the machine frame to load the conveyed ballast in a box car coupled to the machine. At the same time, new ballast is conveyed from the rear end of the machine and is discharged from the hopper of a ballast discharge device immediately rearwardly of the clearing means in the operating direction. At the ballast discharge point, the track is held in a desired vertical position by a track lifting unit. There is no provision for partially or fully reusing the removed ballast.

German patent application No. 4,101,432, published Jul. 23, 1992, discloses a machine for lowering a track. A machine frame runs on the track in an operating direction, and the front end of the machine frame carries a track lifting unit as well as a vertically adjustable arrangement for aspirating ballast from underneath the track until a desired track level has been obtained. The aspirated ballast is conveyed to a hopper at the rear end of the machine frame. A screen for cleaning the aspirated ballast is mounted in the hopper and a conveyor band is provided to convey the detritus away from the hopper. At the rear undercarriage, the track automatically rests on the new, lowered level of the ballast bed and, depending on need, the cleaned ballast from the hopper is distributed in the cribs. In a final operating step, the track may then be tamped.

SUMMARY OF THE INVENTION

It is the primary object of this invention to provide a machine of the first-described type which can be used for rehabilitating subgrade sections underneath the ballast bed while maintaining all the known advantages of such machines.

The above and other objects are accomplished in such a machine according to the invention with a conveyor arrangement extending in the longitudinal direction on the machine frame, the conveyor arrangement having an input end arranged to receive the aspirated ballast from the conveyor band means and an output end arranged to discharge the aspirated ballast into the hopper, and a track lifting unit mounted on the machine frame between the suction opening and the ballast discharge device.

With a minimal additional structure, such a machine makes it possible to produce a relatively long track section free of ballast so that the subgrade can be rehabilitated. It has the further advantage that no time- and labor-extensive intermediate storing of the ballast removed for a short period is required in a storage car coupled to the machine. The entire aspirated ballast is stored in an operating cycle constituted by the suction unit, the conveyor arrangement and the hopper. Very advantageously, the rehabilitation of the exposed subgrade may be effectuated immediately after the removal of the ballast, and the rehabilitated subgrade may be immediately covered again by the ballast from the hopper without requiring special movements of the machine. For these reasons, the times of closing the track to traffic due to rehabilitation work are substantially reduced.

BRIEF DESCRIPTION OF THE DRAWING

The above and other objects, advantages and features of the present invention will become more apparent from the following detailed description of a now preferred embodiment thereof, taken in conjunction with the accompanying, somewhat diagrammatic drawing wherein.

DETAILED DESCRIPTION OF PREFERRED EMBODIMENT

Figure 1:
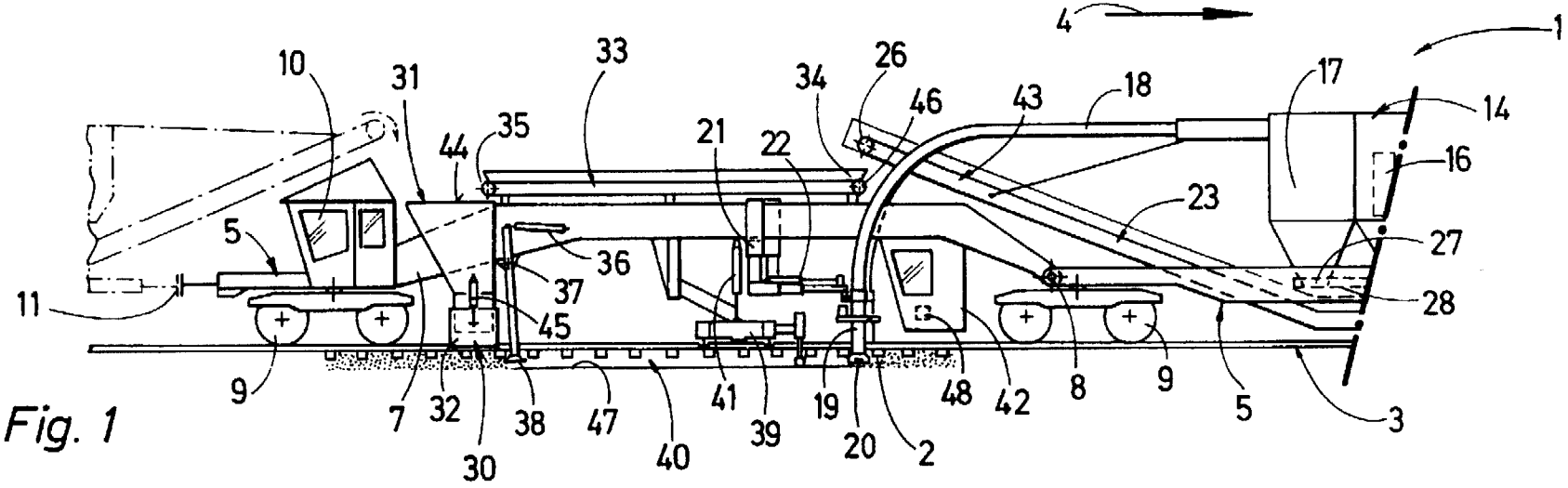
FIGS. 1 and 2 are side elevational views of a machine for treating a ballast bed, FIG. 1 showing the rear portion of the machine and FIG. 2 showing the front portion.

Referring now to the drawing, there is shown machine 1 for treating ballast bed 2 underneath track 3. The machine comprises elongated machine frame 5 extending in a longitudinal direction and comprising front portion 6, shown in FIG. 2, and recessed rear portion 7, shown in FIG. 1. The front and rear machine frame portions are coupled together by universal joint 8 so that they may move relative to each other in all directions, and they are supported on track 3 by three undercarriages 9, two at the ends of the machine frame and one at universal joint 8, for movement in an operating direction indicated by arrow 4. Driver's cabs 10 are mounted on each end of machine frame 5, and the machine frame ends have bumper couplings 11 for connection to other track maintenance cars. Power plant 12 serves to supply energy to drive 13 for moving the machine along the track, as well as all the other operating drives of the machine to be described hereinafter.

Suction unit 14 is mounted on machine frame 5, the suction unit comprising vacuum generator 15, filtering chamber 16, ballast storage container 17 and two suction hoses 18 leading into the ballast storage container. The suction hoses extend substantially parallel to each other and are spaced from each other in a direction extending transversely to the longitudinal direction. The free end of each suction hose carries vertically and laterally adjustable suction pipe 19 having suction opening 20 for aspirating ballast from ballast bed 2. Guide arrangement 21 operated by drive 22 vertically and laterally adjustably mounts each suction pipe 19 in recessed machine frame portion 7.

Conveyor band means 23 is arranged on machine frame 5 to convey the aspirated ballast away from suction unit 14. The conveyor band means has a first section 43 extending below filter chamber 16 and storage container 17 of the suction unit and therefrom rearwardly in the operating direction, a rising section 24 projecting from the first section beyond a front end of machine frame 5 in the operating direction, and comprises drive 29 for selectively revolving conveyor band means 23 in opposite directions so that the direction of conveyance may be reversed. Loading conveyor band 25 is mounted on front machine frame portion 6 and may be longitudinally displaced relative to rising conveyor band means section 24 so that it may be retracted when machine 1 is moved between operating sites and extended into a loading position in which it conveys the aspirated ballast and discharges it into an adjoining box car (indicated in phantom lines). First conveyor band means section 43 extends above universal joint 8 to rear machine frame portion 7 and has raised discharge end 26.

Ballast storage container 17 and filter chamber 16 have discharge ports 27 at undersides thereof immediately above conveyor band means 23, and these discharge ports may be opened and closed by remote-controlled flaps 28.

Ballast discharge device 30 is mounted on machine frame 5 rearwardly of suction pipe 19 and immediately ahead of rear undercarriage 9 in the operating direction, and conveyor arrangement 33 extends in the longitudinal direction on machine frame 5, the conveyor arrangement having input end 34 arranged to receive the aspirated ballast from conveyor band means 23 and output end 35 arranged to discharge the aspirated ballast into hopper 31 of the ballast discharge device 30. The hopper 31 is a ballast storage container having a top input opening arranged to receive the aspirated ballast from output end 35 of conveyor arrangement 33 and ballast discharge chute means below the input opening and immediately above track 3. The ballast discharge chutes 32 are controllable for being selectively opened and closed. Conveyor arrangement 33 is operated by drive 46 and extends along rear machine frame portion 7 and is mounted on top of the recessed machine frame portion, input end 34 of the conveyor arrangement receiving the aspirated ballast from discharge end 25 of conveyor band means 23 and output end 35 being positioned to discharge the ballast into hopper 31.

The machine of further comprises ballast compaction beam 38 immediately preceding ballast discharge device 30 in the operating direction, the ballast compaction beam being vertically adjustable and pivotal about horizontal axis 37 extending transversely to the longitudinal direction, and drive 36 is arranged to pivot the ballast compaction beam.

The recessed machine frame portion houses suction pipes 20, track lifting unit 39 mounted on machine frame 5 between suction opening 20 and ballast discharge device 30, and ballast discharge device 30 so that the aspiration of the ballast creates an operating site 40, wherein exposed subgrade section 47 is formed, between suction openings 20 of suction pipes 19 and discharge chutes 32 of ballast discharge device 30. Operator's cab 48 is mounted on machine frame 5 in the recessed portion thereof between intermediate undercarriage 9 and suction pipes 19, and the cab houses central control panel 48. Track lifting unit 39 is spaced from suction openings 20 and discharge chute 32 and is connected to machine frame 5 by vertical adjustment drive 41.

In operation, machine 1 is driven to operating site 40, and the operation starts by lowering suction pipes 19 and aspirating the ballast continuously through suction openings 20 until subgrade 47 at the operating site is exposed for rehabilitation work. At the same time, track lifting unit 39 holds the track in its original position while it is unsupported by ballast bed 2. As soon as subgrade 47 between suction pipes 19 and ballast compaction beam 38 is free of ballast, the advancement of the machine in the operating direction may be stopped, and the rehabilitation work may begin. The machine may be similarly used to expose a fixed structure, such as a bridge, for rehabilitation work, instead of a subgrade. After the rehabilitation work has been completed, the two suction pipes are raised and suction is stopped, and the machine is continuously advanced again while ballast discharge chutes 32 are opened to redistribute the ballast in the track bed. Drives 45 for opening the discharge chutes are preferably controlled by an operator in rear driver's cab 10. At the same time, ballast compaction beam 38 is reciprocated in the longitudinal direction by pivoting the same about axis 37 to compact the redistributed ballast in the cribs.

In addition to the operation described hereinabove, machine 1 may also be used for creating a continuous operating site 40 as the machine is advanced without interruption as ballast is continuously aspirated at a forward end of the operating site and continuously redistributed and compacted at a rear end of the operating site.

Figure 2:
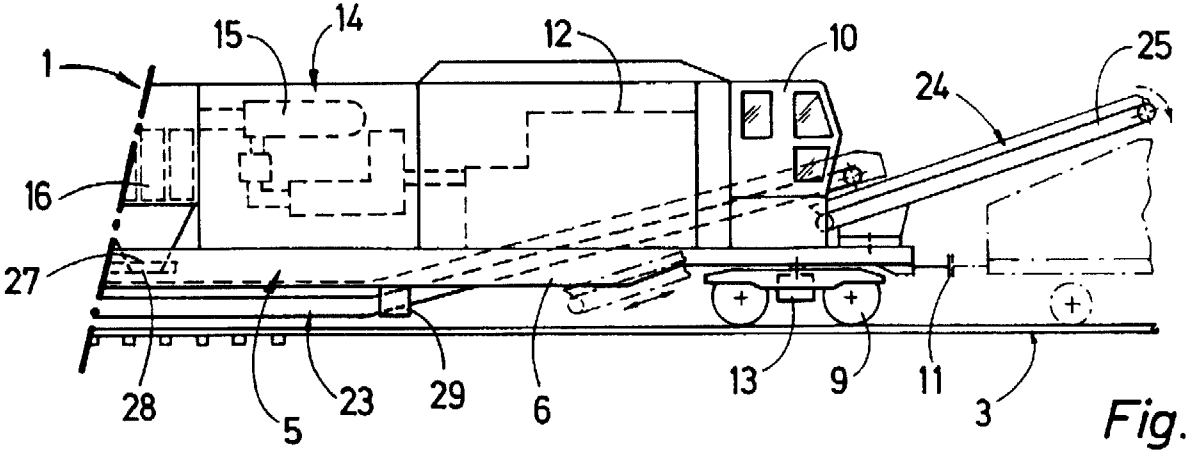

If the aspirated ballast is heavily encrusted and, therefore, cannot be used again, it may be conveyed by conveyor band means 23 and loading conveyor band 25 to a storage car coupled to machine 1, as indicated in phantom lines in FIG. 2. At the same time, as indicated in phantom lines in FIG. 1, new ballast may be conveyed to top input opening 44 of hopper 31 for distribution through discharge chutes 32. Such an additional supply of ballast may also be useful in case the amount of aspirated ballast is insufficient to fill the ballast bed.

What is claimed is:

1. A machine for treating a ballast bed underneath a track, comprising (a) a machine frame extending in a longitudinal direction and supported on the track by undercarriages for movement in an operating direction, (b) a suction unit mounted on the machine frame, the suction unit comprising (1) a vertically and laterally adjustable suction pipe having a suction opening for aspirating ballast from the ballast bed, (c) a conveyor band means arranged on the machine frame to convey the aspirated ballast away from the suction unit, (d) a ballast discharge device mounted on the machine frame rearwardly of the suction pipe in the operating direction, the ballast discharge device comprising (1) a hopper, (e) a conveyor arrangement extending in the longitudinal direction on the machine frame, the conveyor arrangement having (1) an input end arranged to receive the aspirated ballast from the conveyor band means and (2) an output end arranged to discharge the aspirated ballast into the hopper, and (f) a track lifting unit mounted on the machine frame between the suction opening and the ballast discharge device.

2. The machine of claim 1, wherein the conveyor band means has an output end, and the input end of the conveyor arrangement is arranged below the output end of the conveyor band means.

3. The machine of claim 2, wherein the conveyor band means has a first section extending from the suction unit rearwardly in the operating direction, a further section projecting from the first section beyond a front end of the machine frame in the operating direction, and comprises a drive for selectively revolving the conveyor band means in opposite directions.

4. The machine of claim 1, wherein the hopper is a ballast storage container having an input opening arranged to receive the aspirated ballast from the output end of the conveyor arrangement and ballast discharge chute means below the input opening, the ballast discharge chute means being controllable for being selectively opened and closed.

5. The machine of claim 1, further comprising a ballast compaction beam immediately preceding the ballast discharge device in the operating direction, the ballast compaction beam being vertically adjustable and pivotal about a horizontal axis extending transversely to the longitudinal direction, and a drive for pivoting the ballast compaction beam.

6. The machine of claim 1, wherein the machine frame has a recessed portion housing the suction pipe, the track lifting unit and the ballast discharge device, further comprising an operator's cab mounted on the machine frame in the recessed portion thereof.

7. The machine of claim 1, further comprising driver's cabs mounted on each end of the machine frame.

* * * * *